US006073297A

United States Patent [19]

Lee

[11] Patent Number: 6,073,297

[45] Date of Patent: Jun. 13, 2000

[54] AUTOMATIC ERASING DEVICE FOR ERASING CHALK MARKS ON A WRITING BOARD

[76] Inventor: Chun-Hsien Lee, 9F, No. 7, Alley 2, Lane 98, Sec. 1, Hsueh-Fu Rd., Tu-Cheng City Taipei Hsien, Taiwan

[21] Appl. No.: 09/170,942

[22] Filed: Oct. 13, 1998

[51] Int. Cl.[7] ..... A47L 11/38

[52] U.S. Cl. ..... 15/102; 15/246; 15/97.1

[58] Field of Search ..... 15/246, 97.1, 103, 15/102

[56] References Cited

U.S. PATENT DOCUMENTS

| | | |
|---|---|---|
| 1,227,205 | 5/1917 | Sartakoff . |
| 2,167,296 | 7/1939 | Farmer . |
| 3,163,943 | 1/1965 | Bell . |
| 3,731,335 | 5/1973 | Chrisp . |
| 3,858,265 | 1/1975 | Schlick . |
| 5,216,776 | 6/1993 | Dennison . |
| 5,319,820 | 6/1994 | Forst . |
| 5,649,828 | 7/1997 | Kawashima . |
| 5,957,700 | 8/1999 | Ariyama . |

*Primary Examiner*—Terrence R. Till
*Assistant Examiner*—Jennifer McNeil
*Attorney, Agent, or Firm*—Brinks Hofer Gilson & Lione

[57] ABSTRACT

An automatic erasing device is used for erasing chalk marks on a writing board, and includes an erasing mechanism having an elongate housing adapted to be disposed frontwardly of and slidable relative to the writing board between left and right end portions along a longitudinal axis. The elongate housing extends in a transverse axis relative to the longitudinal axis, and has a rear wall formed with an elongate rear opening to confront the writing board. Upper and lower axles are journalled in the elongate housing parallel to the longitudinal axis. A transmitting belt is trained on the upper and lower axles under tension for movement along a rear route proximate to and in alignment with the elongate rear opening, and along a front route parallel to the rear route distal to the elongate rear opening. Several eraser members are mounted detachably on the transmitting belt. The eraser members, when moving along the rear route, protrude outwardly and rearwardly of the rear wall via the elongate rear opening to abut against the writing board. A driving motor drives the upper and lower axles so as to move the eraser members along the front and rear routes. The elongate housing is further driven to move reciprocally in the longitudinal axis, is biased toward the writing board.

9 Claims, 4 Drawing Sheets

AUTOMATIC ERASING DEVICE FOR ERASING CHALK MARKS ON A WRITING BOARD

BACKGROUND OF THE INVENTION

1. Field of the Invention

The invention relates to an erasing device, more particularly to an automatic erasing device for erasing chalk marks from a writing board.

2. Description of the Related Art

Conventionally, the chalk marks on a writing board are erased manually, resulting in inconvenience and consequently polluting the air with chalk powder that can cause ill effects to one's health.

SUMMARY OF THE INVENTION

Therefore, the object of this invention is to provide an automatic erasing device that can erase chalk marks on a writing board and that is clear of the aforementioned disadvantages resulting from manual erasing of the chalk marks.

Accordingly, an automatic erasing device of this invention is adapted for erasing chalk marks on a writing board which has left and right end portions that extend in a longitudinal axis thereof and an intermediate portion between the left and right end portions. The erasing device comprises an erasing mechanism that includes an elongate housing adapted to be disposed frontwardly of and slidable relative to the writing board. The elongate housing extends in a transverse axis relative to the longitudinal axis, and has upper and lower portions, and a rear wall formed with an elongate rear opening to confront the writing board. The elongate rear opening extends from the upper portion to the lower portion of the rear wall. Upper and lower axles are journalled in the elongate housing proximate to the upper and lower portions, respectively. The axles extend parallel to the longitudinal axis. A transmitting belt is trailed on the upper and lower axles under tension and is rotated upon rotation of the upper and lower axles for movement along a rear route proximate to and in alignment with the elongate rear opening, and a front route parallel to the rear route and distal to the elongate rear opening. A plurality of eraser members are disposed detachably on, and are spaced from one another along a circumferential outer surface of the transmitting belt. Each of the eraser members, when moving along the rear route, protrudes outwardly and rearwardly of the rear wall via the elongate rear opening and is adapted to abut against the writing board. A driving motor is disposed to drive either one of the upper and lower axles so as to move the eraser members along the front and rear routes. The elongate housing is driven to move reciprocally in the longitudinal axis between the left and right end portions of the writing board, and is biased toward the writing board while the elongate housing is being moved reciprocally in the longitudinal axis.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
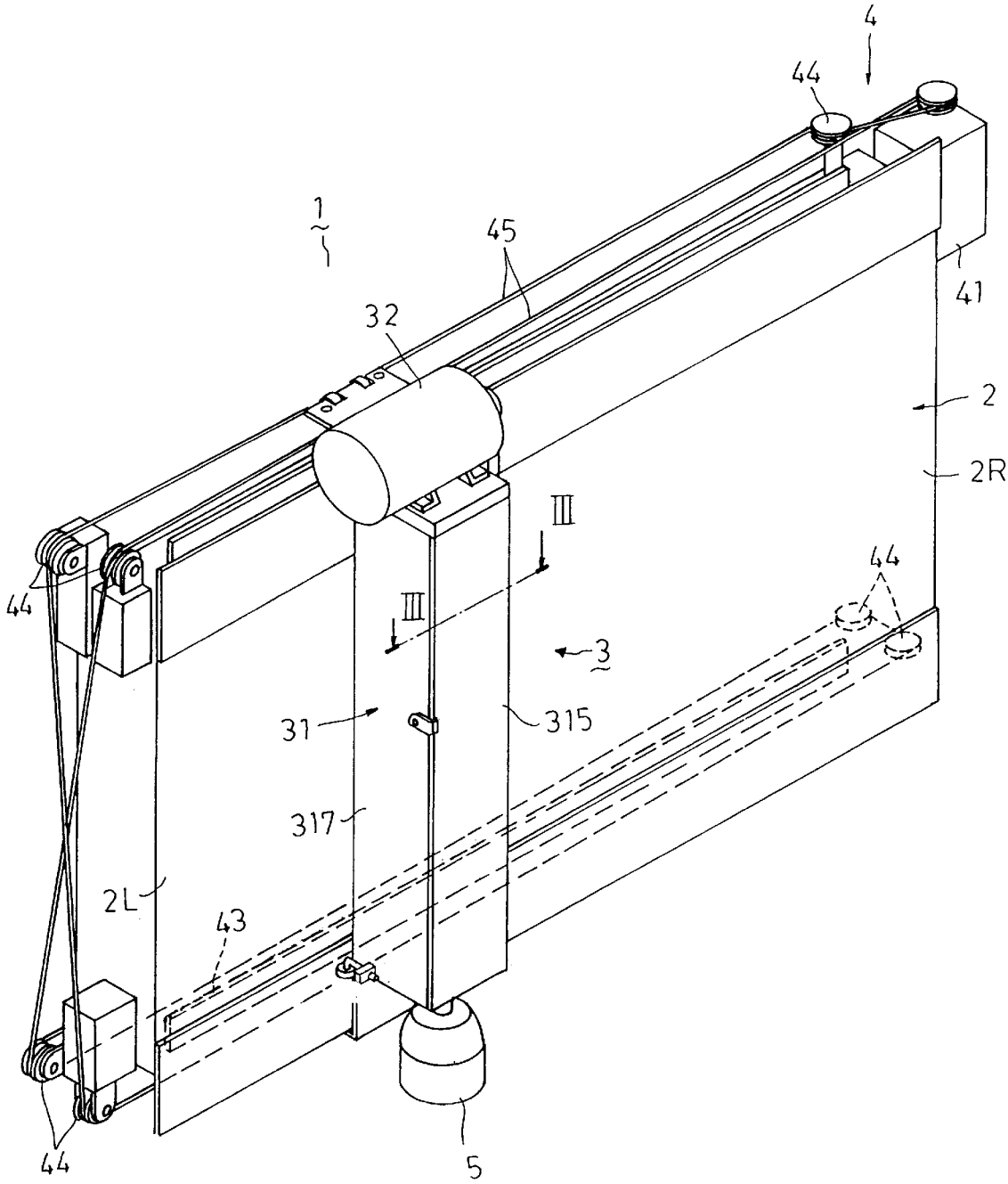
FIG. 1 is a perspective view of a preferred embodiment of an automatic erasing device of this invention when mounted on a writing board for erasing the chalk marks on the writing board.
Figure 2:
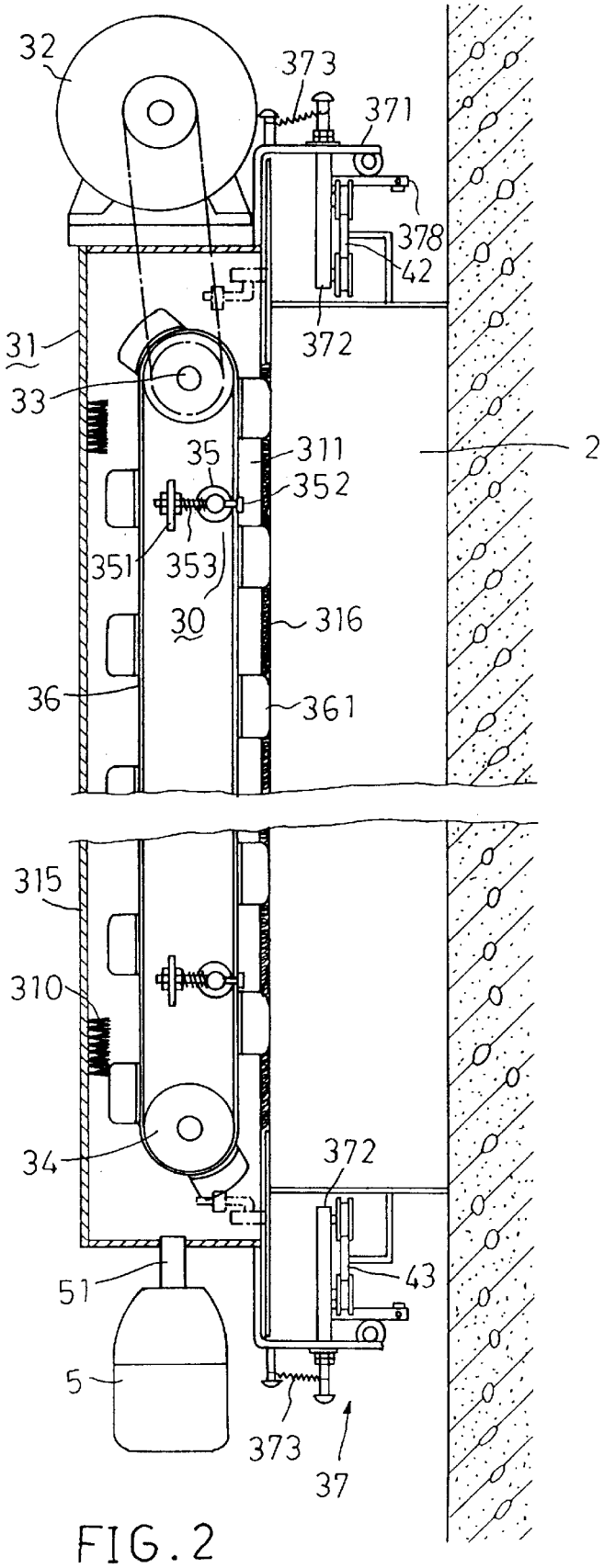
FIG. 2 is a fragmentary sectional view of the preferred embodiment when mounted on the writing board.

Referring to FIGS. 1 and 2, the preferred embodiment of an automatic erasing device 1 of this invention is shown to be mounted on a writing board 2 for erasing chalk marks thereon.

As illustrated, the writing board 2 has left and right end portions 2L, 2R that extend in a longitudinal axis, and an intermediate portion between the left and right end portions 2L, 2R. The preferred embodiment includes erasing mechanism with an elongate housing 31 adapted to be disposed frontwardly of and slidable relative to the writing board 2. The elongate housing extends in a transverse axis relative to the longitudinal axis, and has upper and lower portions, and a rear wall 311 formed with an elongate rear opening 311R (see FIG. 3) to confront the writing board 2.

The elongate rear opening 311R extends from the upper portion to the lower portion of the rear wall 311. The erasing mechanism further includes upper and lower axles 33, 34 journalled in the elongate housing 31 proximate to the upper and lower portions, respectively. The axles 33, 34 extend parallel to the longitudinal axis. A transmitting belt 36 is trained on the upper and lower axles 33, 34 under tension so as to be rotated upon rotation of the upper and lower axles 33, 34. The transmitting belt 36 is movable along a rear route that is proximate to, and in alignment with the elongate rear opening 311R, and a front route that is parallel to the rear route and distal to the elongate rear opening 311R. A plurality of eraser members 361 are disposed detachably on, and are spaced from one another along a circumferential outer surface of the transmitting belt 36. Each of the eraser members 361, when moving along the rear route, protrudes outwardly and rearwardly of the rear wall 311 via the elongate rear opening 311R to abut against the writing board 2.

A driving motor 32 is disposed to drive either one of the upper and lower axles 33, 34 so as to move the eraser members 361 along the front and rear routes. The driving motor 32 further drives the elongate housing 31 to move reciprocally in the longitudinal axis between the left and right end portions 2L, 2R of the writing board 2.

The elongate housing 31 is biased by first biasing means toward the writing board 2 while the elongate housing 31 is being moved reciprocally in the longitudinal axis.

In the preferred embodiment, the elongate housing 31 has a front inner wall 315 disposed to be spaced frontwardly of the front route, and provided with a plurality of spaced scrubbing brushes 310 thereon in alignment with and capable of scrubbing the eraser members 361 when the latter are moved along the front route. The elongate housing 31 has left and right lateral side walls 317 transversely disposed to the rear wall 311 and spaced apart from each other in the longitudinal axis.

Figure 3:
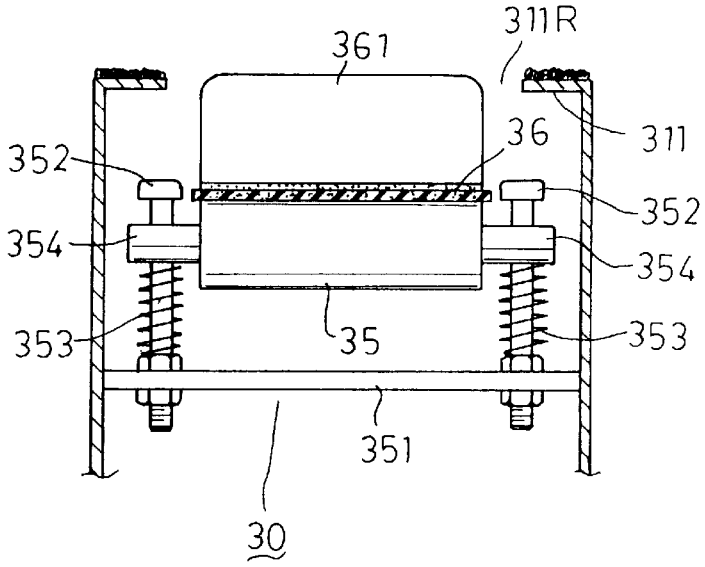
FIG. 3 is a fragmentary sectional view of the preferred embodiment taken along lines III—III in FIG. 1.

Referring to FIG. 3, the erasing device further includes second biasing means 30 mounted across the lateral side walls 317 and disposed on one side of the rear route opposite to the rear wall 311 to bias the transmitting belt 36 toward the rear wall 311 so as to urge the eraser members 361 to protrude outwardly of the rear wall 311 for abutment against the writing board 2 once the eraser members 361 are registered with the second biasing means 30. The second biasing means 30 includes a shaft 354 disposed transversely to the lateral side walls 317, and guided to move in an urging direction towards the elongate rear opening 311R, a roller 35 rotatably mounted on the shaft 354, and a spring member 353 disposed to bias the shaft 354 to move in the urging direction so as to bring the roller 35 to abut against and be rotated by turning of the transmitting belt 36. Preferably, two opposite ends of the shaft 354 are formed with radial holes for sleeving on two mounting rods 352, which, in turn, are mounted on a positioning plate 351 that is disposed transversely between the lateral side walls 317. Preferably, the rear wall 311 has an outer peripheral edge portion to define the elongate rear opening 311R. A layer of felt 316 (see FIG. 2) is disposed on and along the outer peripheral edge portion and is adapted to slidably contact the writing board 2 so as to prevent the chalk powder scrubbed during erasing of the writing board from falling out of the elongate housing 31.

The elongate housing 31 further has a dustbin 5 provided at the lower portion the elongate housing 31 and in communication with an interior thereof by a connecting pipe 51 for collecting the chalk powder that results when the chalk marks are erased by the erasing members 361.

Figure 4:
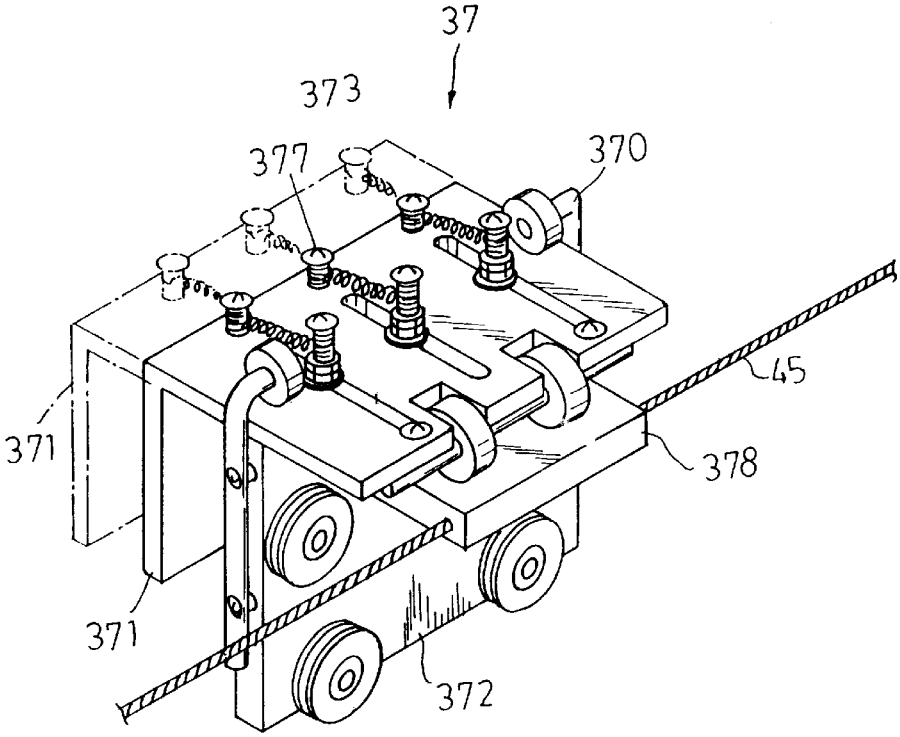
FIG. 4 illustrates first biasing means employed in the preferred embodiment.

Referring to FIG. 4, the first biasing means includes a pair of cable railway units adapted to be disposed at top and bottom portions of the writing board 2 (see FIG. 2). Each of the cable railway units includes a railway 42, 43 that extends along the longitudinal axis and that is adapted be disposed between the left and right end portions of the writing board 2, a carriage 372 disposed to be movable on the railway 42, 43, a cable 45 for carrying the carriage 372 to move on the railway 42, 43 along the longitudinal axis, and a bridging member 371 fixed to either the upper or lower portion of the elongate housing 31. The bridging member 371 has a span portion 378 that extends above and that is slidable relative to the carriage 372 so as to permit movement of the elongate housing 31 in the urging direction while the carriage 372 is being moved on the railway 42, 43. A plurality of tension springs 353 are disposed between the bridging member 371 and the carriage 372 to urge the elongate housing 31 to move in the urging direction.

Referring again to FIG. 1, the reciprocal driving means 4 includes a plurality of direction transmitting pulleys 44 adapted to be mounted rotatably at corners of the writing board 2 to permit the cable 45 to be trained thereon, and a bidirectional motor 41 for rotating the transmitting pulleys 44 in clockwise and counterclockwise directions, which, in turn, moves the cable 45 to bring the elongate housing 31 to move reciprocally along the longitudinal axis.

Figure 5:
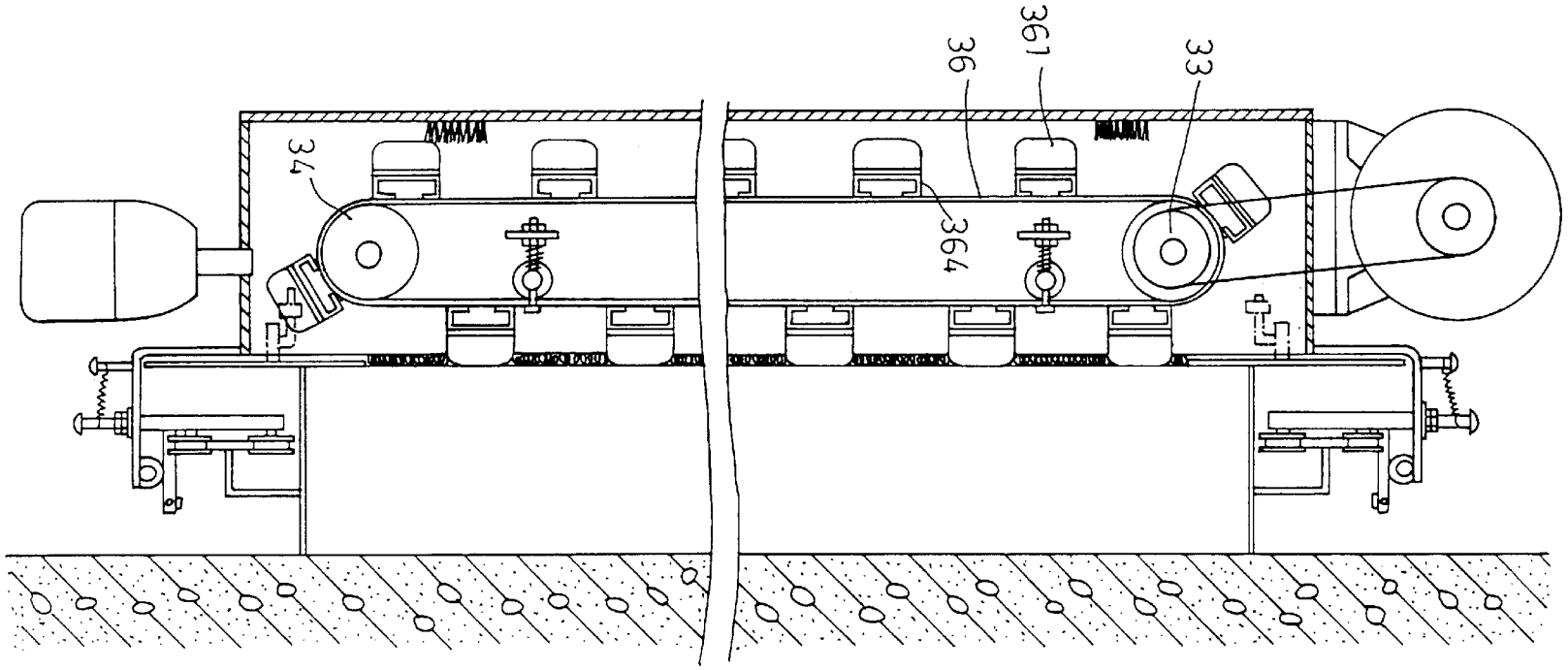
FIG. 5 is a fragmentary sectional view of a second preferred embodiment of this invention when mounted on a writing board.

FIG. 5 shows another preferred embodiment of this invention which is generally similar to the previous embodiment in structure, except for a plurality of resilient mounting seats 364 mounted on the circumferential outer surface of the transmitting belt 36 in order to receive a corresponding one of the eraser members 361 thereon so as to provide a yielding action to the eraser member 361 while the eraser member 361 is being moved to be swept by the scrubbing brushes 310 (see FIG. 2) or to erase the chalk marks on the writing board.

As illustrated above, the automatic erasing device of this invention can avoid pollution of the air when in use and is very convenient to use. The objects of this invention are thus achieved.

With this invention thus explained, it is apparent that numerous modifications and variations can be made without departing from the scope and spirit of this invention. It is therefore intended that this invention be limited only as indicated in the appended claims.

I claim:

1. An automatic erasing device for erasing chalk marks on a writing board, the writing board having left and right end portions extending in a longitudinal axis thereof and an intermediate portion between said left and right end portions, said erasing device comprising:

an erasing mechanism including an elongate housing adapted to be disposed frontwardly of and slidable relative to the writing board, said elongate housing extending in a transverse axis relative to the longitudinal axis, and having upper and lower portions, and a rear wall formed with an elongate rear opening to confront the writing board and extending from said upper portion to said lower portion;

upper and lower axles journalled in said elongate housing proximate to said upper and lower portions, respectively, each of said upper and lower axles extending parallel to the longitudinal axis;

a transmitting belt trained on said upper and lower axles under tension so as to be rotated upon rotation of said upper and lower axles, said transmitting belt being movable along a rear route proximate to, and being in alignment with said elongate rear opening, and a front route parallel to said rear route and distal to said elongate rear opening; and a plurality of eraser members disposed detachably on, and spaced from one another along a circumferential outer surface of said transmitting belt, each of said eraser members, when moving along said rear route, protruding outwardly and rearwardly of said rear wall via said elongate rear opening and being adapted to abut against the writing board;

a driving motor disposed to drive either one of said upper and lower axles so as to move said eraser members along said front and rear routes;

means for driving said elongate housing to move reciprocally in said longitudinal axis between the left and right end portions of the writing board; and first means for biasing said elongate housing toward the writing board while said elongate housing is being moved reciprocally in said longitudinal axis.

2. The automatic erasing device as defined in claim 1, wherein said elongate housing has a front inner wall disposed to be spaced frontwardly of said front route, and provided with a plurality of spaced scrubbing brushes thereon in alignment with and capable of scrubbing said eraser members when said eraser members move along said front route.

3. The automatic erasing device as defined in claim 2, further comprising a plurality of resilient mounting seats each of which is mounted on said circumferential outer surface of said transmitting belt in order to receive a corresponding one of said eraser members thereon so as to provide a yielding action to said eraser member while said eraser member is being moved to be swept by said scrubbing brushes or to erase the chalk marks on the the writing board.

4. The automatic erasing device as defined in claim 1, wherein said elongate housing has left and right lateral side walls transversely disposed to said rear wall respectively and spaced apart from each other in said longitudinal axis, said erasing device further comprising:

second biasing means mounted across said lateral side walls and disposed on one side of said rear route opposite to said rear wall to bias said transmitting belt toward said rear wall so as to urge said eraser members to protrude outwardly of said rear wall so as to enable said eraser members to abut against the writing board once said eraser members are registered with said second biasing means.

5. The automatic erasing device as defined in claim 4, wherein said second biasing means includes a shaft disposed transversely to said lateral side walls, and guided to move in an urging direction towards said elongate rear opening, a roller rotatably mounted on said shaft, and a spring member disposed to bias said shaft to move in said urging direction so as to bring said roller to abut against and be rotated by turning of said transmitting belt.

6. The automatic erasing device as defined in claim 1, wherein said rear wall has an outer peripheral edge portion to define said elongate rear opening, said erasing device further comprising:

a layer of felt disposed on and along said outer peripheral edge portion and adapted to slidably contact the writing board so as to prevent chalk powder scrubbed during erasing of the writing board from falling out of said elongate housing.

7. The automatic erasing device as defined in claim 1, wherein said elongate housing further has a dustbin provided at said lower portion and in communication with an interior of said elongate housing for collecting the chalk powder that results when the chalk marks are erased by said erasing members.

8. The automatic erasing device as defined in claim 1, wherein said first biasing means includes a pair of cable railway units adapted to be disposed at top and bottom portions of the writing board, each of said cable railway units including:

a railway extending along said longitudinal axis and adapted be disposed between the left and right end portions of the writing board;

a carriage disposed to be guidingly movable on said railway;

a cable for carrying said carriage to move on said railway along said longitudinal axis;

a bridging member fixed to either said upper or lower portion of said elongate housing, and having a span portion extending above and slidable relative to said carriage so as to permit movement of said elongate housing in said urging direction while said carriage is being moved on said railway; and a plurality of tension springs disposed between said bridging member and said carriage to urge said elongate housing to move in said urging direction.

9. The automatic erasing device as defined in claim 8, wherein said reciprocal driving means includes:

a plurality of direction transmitting pulleys adapted to be mounted rotatably at corners of the writing board to permit said cable to be trained thereon; and a bidirectional motor for rotating said transmitting pulleys in clockwise and counterclockwise directions which, in turn, moves said cable to bring said elongate housing to move reciprocally along said longitudinal axis.

* * * * *